US008460030B2

(12) United States Patent
Chang

(10) Patent No.: US 8,460,030 B2
(45) Date of Patent: Jun. 11, 2013

(54) CONNECTOR WITH DETACHABLE MODULE

(76) Inventor: Nai-Chien Chang, New Taipei (TW)

( * ) Notice: Subject to any disclaimer, the term of this patent is extended or adjusted under 35 U.S.C. 154(b) by 230 days.

(21) Appl. No.: 13/164,831

(22) Filed: Jun. 21, 2011

(65) Prior Publication Data

US 2012/0329329 A1 Dec. 27, 2012

(51) Int. Cl.
*H01R 25/00* (2006.01)

(52) U.S. Cl.
USPC ..... 439/541.5; 439/929

(58) Field of Classification Search
USPC ..... 439/541.5, 620.15–620.18, 929
See application file for complete search history.

(56) References Cited

U.S. PATENT DOCUMENTS 5,156,556 A * 10/1992 Ma ..... 439/357
6,062,908 A * 5/2000 Jones ..... 439/620.07
6,210,238 B1 * 4/2001 Akimoto et al. ..... 439/692
6,991,496 B2 * 1/2006 Kuribayashi et al. .... 439/620.04
7,065,381 B2 * 6/2006 Jenkins et al. ..... 455/556.1
7,201,585 B2 * 4/2007 Pirner et al. ..... 439/76.1
7,699,624 B2 * 4/2010 Muramatsu ..... 439/76.2
7,874,874 B2 * 1/2011 Chang ..... 439/620.01
7,892,023 B2 * 2/2011 Chang ..... 439/577
7,905,750 B2 * 3/2011 Mo ..... 439/541.5
7,942,702 B2 * 5/2011 Chang ..... 439/638
8,137,137 B1 * 3/2012 Chang ..... 439/607.07
8,162,691 B2 * 4/2012 Chang ..... 439/541.5
8,286,879 B2 * 10/2012 Chang ..... 235/486
8,357,010 B2 * 1/2013 Pocrass ..... 439/620.22
2012/0302106 A1 * 11/2012 Chang ..... 439/701
2012/0329329 A1 * 12/2012 Chang ..... 439/626
2013/0050959 A1 * 2/2013 Chang ..... 361/736

* cited by examiner

*Primary Examiner* — Neil Abrams
(74) *Attorney, Agent, or Firm* — Chun-Ming Shih; HDLS IPR Services

(57) ABSTRACT

A connector includes a main body and a detachable module. The main body has an insulation base and a plurality of pin header slots. The rear surface of the insulation base is provided with a plurality of troughs. The pin header slots are disposed in the troughs. Each pin header slot extends toward the top surface of the insulation base. The detachable module includes a circuit board, an integrated circuit and a plurality of pin headers both electrically connected to the circuit board. When the detachable module is assembled with the main body in such a manner that the pin headers are electrically connected to the pin header slots, a mother board connected to the main body can perform the functions of the integrated circuit of the detachable module.

20 Claims, 6 Drawing Sheets

CONNECTOR WITH DETACHABLE MODULE

BACKGROUND OF THE INVENTION

1. Field of the Invention

The present invention relates to a connector, and in particular to a connector in which at least one detachable module is inserted.

2. Description of Prior Art

With the advancement of electronic industry, various kinds of electronic devices are widely used in our daily life. In order to input commands to control the electronic devices or transmit data among the respective electronic devices, most of the electronic devices are provided with a connector for this purpose.

For example, a personal computer is a very popular electronic device, on which a plurality of connectors is provided, such as a Universal Series Bus (USB) connector, an External Serial Advance Technology Attachment (e-SATA) connector, a RJ-45 connector, a High Definition Multimedia Interface (HDMI) connector or the like. A transmission line is connected to an external control device for receiving the inputted commands. Alternatively, a transmission line is connected to another electronic device for transmitting data among the respective electronic devices.

In order to save the transmission lines and extend the data transmission distance, the current electronic device is provided with a wireless transmission module, such as a Radio Frequency (RF) module, an Infrared Rays (IR) module, a Bluetooth module, or a Wireless Fidelity (Wi-Fi) module. Each of the electronic devices transmits data by means of its associated wireless transmission module. In this way, the cost of the transmission lines is saved, and the data can be transmitted more rapidly.

However, no matter in the connector or the wireless transmission module, a circuit board (or a mother board) inside the electronic device occupies a large space. If more connectors or wireless transmission modules are mounted on the circuit board, these connectors or wireless transmission modules inevitably occupy a larger space on the circuit board. As a result, the circuit board needs to be made larger accordingly. Further, the circuitry on the circuit board has to be re-arranged carefully, which increases the difficulty in production.

Thus, a stacked connector assembly is proposed, in which a plurality of connectors and wireless transmission modules are stacked up vertically. By this arrangement, the occupied area on the circuit board is equal to that of one connector. Although a plurality of connectors and wireless transmission modules of the same kind or different kinds can be integrated in such a stacked connector assembly, the connectors are fixedly mounted in the stacked connector assembly, which means that a user cannot change the fixed connectors and wireless transmission modules on demands. For example, a USB connector, a SATA connector and a Bluetooth wireless transmission module are integrated on the stacked connector assembly to occupy a reduced space on the mother board, however, such a stacked connector assembly cannot provide a Wi-Fi function because there is no Wi-Fi module in such a stacked connector assembly. As a result, it is necessary to additionally mount a Wi-Fi module on the mother board.

In view of the above, there is a need for a novel connector assembly, in which a plurality of connectors and wireless transmission modules are integrated. Further, the wireless transmission modules can be freely detached from the connector assembly and replaced by other kinds of wireless transmission modules, thereby increasing the practicability and convenience of the connector assembly.

SUMMARY OF THE INVENTION

The present invention is to provide a connector with a detachable module. Detachable modules of different functions can be inserted into and/or detached from the main body of the connector, thereby increasing the expandability of the connector.

The present invention provides a connector with a detachable module, which includes a main body and a detachable module. The main body has an insulation base and a plurality of pin header slots. The rear surface of the insulation base is provided with a plurality of troughs. The pin header slots are disposed in the troughs. Each pin header slot extends toward the top surface of the insulation base. The detachable module includes a circuit board, an integrated circuit and a plurality of pin headers both electrically connected to the circuit board. When the detachable module is assembled with the main body in such a manner that the pin headers are electrically connected to the pin header slots, a mother board connected to the main body can perform the functions of the integrated circuit of the detachable module.

In comparison with prior art, the present invention has advantageous features as follows. The main body is provided with a plurality of pin header slots into which a detachable module having different functions (integrated circuits) can be inserted. In this way, the mother board electrically connected to the main body can be electrically connected to the detachable module via the main body, thereby performing the functions of the integrated circuit in the detachable module. Thus, the user can replace the detachable module by another one on demands to change or expand the functions of the connector. As a result, it is convenient for the user to use the connector of the present invention for generating different changeable functions. Further, the connector of the present invention occupies a reduced space on the mother board. On the other hand, even detachable, the detachable module is still electrically connected to the main body very stably.

DETAILED DESCRIPTION OF THE INVENTION

Figure 1:
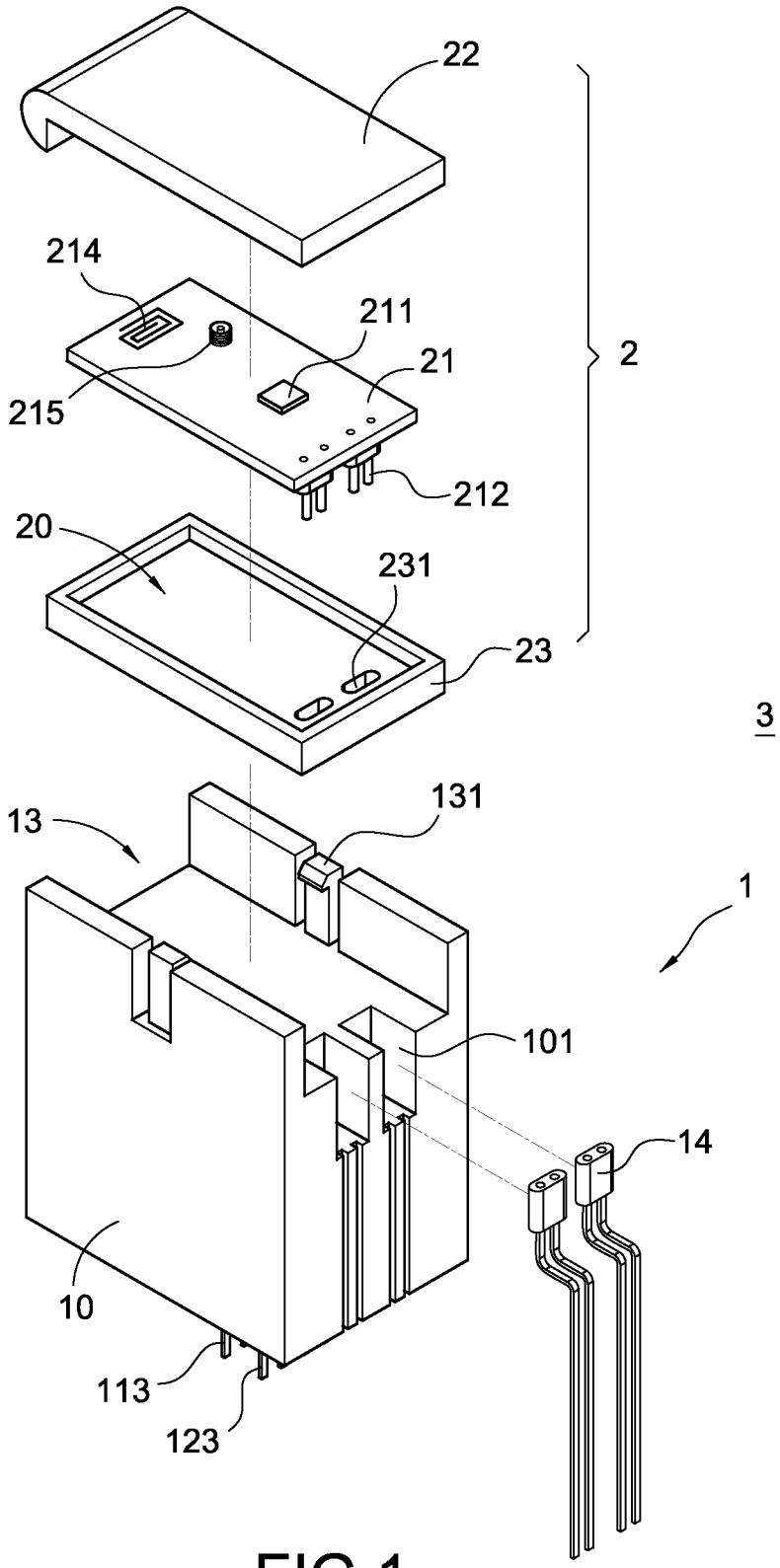
FIG. 1 is an exploded perspective view showing a preferred embodiment of the present invention.
Figure 2:
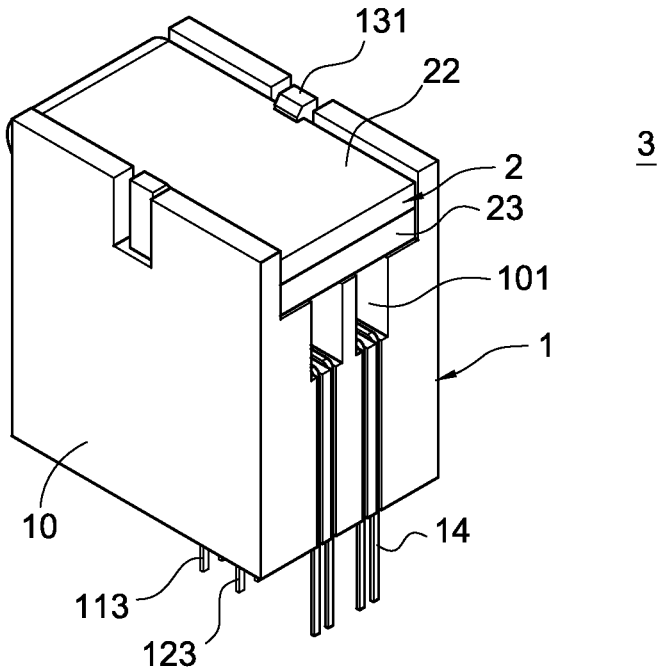
FIG. 2 is a first assembled perspective view showing a preferred embodiment of the present invention.
Figure 3:
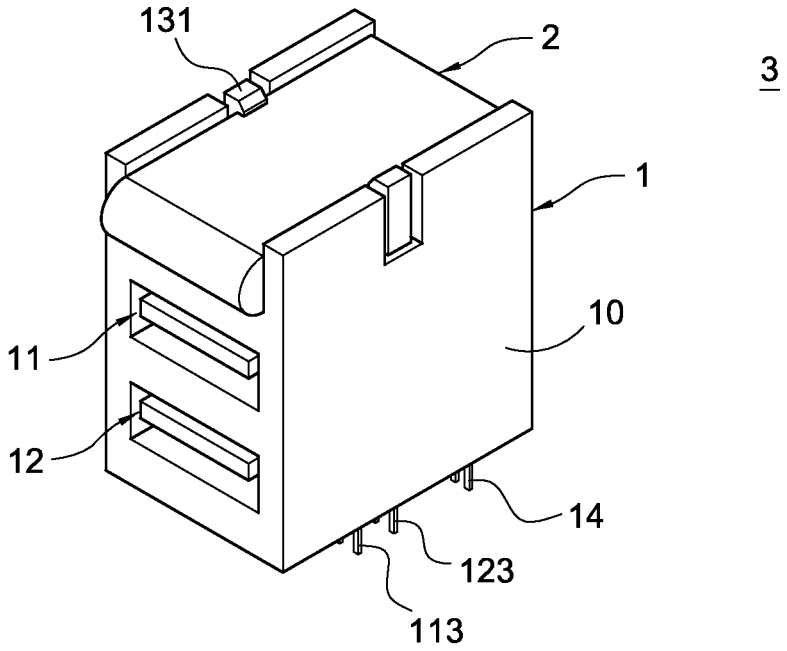
FIG. 3 is a second assembled perspective view showing a preferred embodiment of the present invention.
Figure 4:
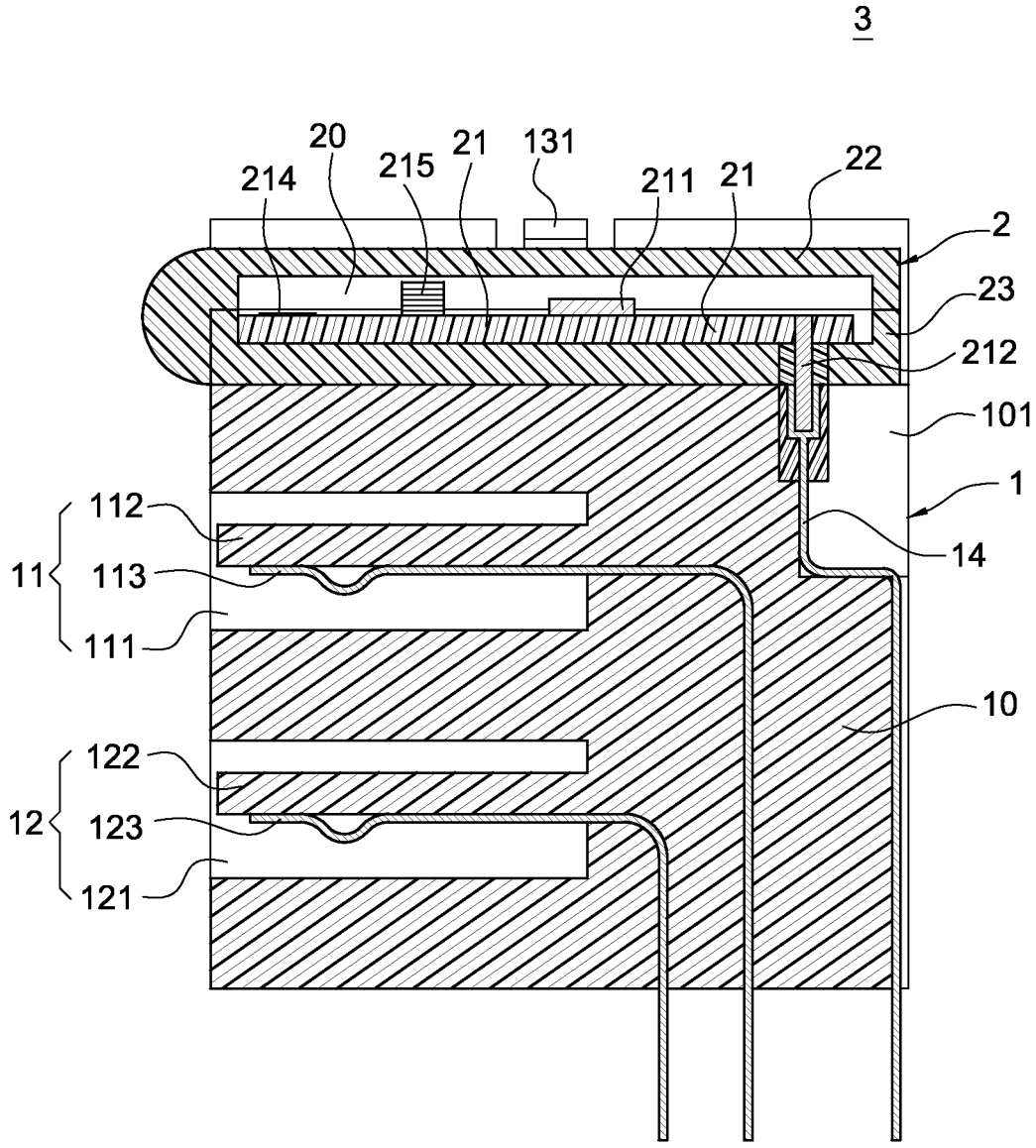
FIG. 4 is a side view showing a preferred embodiment of the present invention.

The detailed description and technical contents of the present invention will become apparent with the following detailed description accompanied with related drawings. It is noteworthy to point out that the drawings is provided for the illustration purpose only, but not intended for limiting the scope of the present invention.

FIGS. 1 to 4 are an exploded perspective view, a first assembled perspective view, a second assembled perspective view, and a side view of a preferred embodiment of the present invention, The present invention provides a connector 3 with a detachable module, which includes a main body 1 and a detachable module 2.

The main body 1 has an insulation base 10 and a plurality of pin header slots 14. The insulation base 10 is a casing made of plastic materials, but it is not limited thereto. The front surface of the insulation base 10 is provided with at least one accommodating trough 111, 112. Each of the accommodating troughs 111, 112 has a tongue piece 112, 122 respectively. The tongue pieces 112, 122 are provided with a plurality of connecting terminals 113, 123 respectively. Each of the accommodating space 111, 121 and the tongue pieces 112, 122 and the connecting terminals 113, 123 together constitute a connecting port 11, 12.

For example, if there are four connecting terminals 113 in the accommodating trough 111, the accommodating trough 111, the tongue piece 112 and the connecting terminals 113 together constitute a USB connecting port 11. If there are seven connecting terminals 123 in the accommodating trough 121, the accommodating trough 121, the tongue piece 122 and the connecting terminals 123 together constitute an e-SATA connecting port 12. In the present embodiment, two USB connecting ports are used as an example. However, the connecting ports 11, 12 are not limited to USB connecting ports only, and the number of the connecting ports may not be limited to two.

The rear surface of the insulation base 10 is provided with a plurality of troughs 101. The pin header slots 14 are correspondingly disposed in the troughs 101. The openings of the pin header slots 14 extend toward the top surface of the insulation base 10 and are perpendicular to the top surface of the insulation base 10. In the present embodiment, there are four pin header slots 14, but it is not limited thereto.

The top surface of the insulation base 10 is provided with a connecting channel 13. Both sides of the connecting channel 13 are provided with a fixing post 131 respectively. When the detachable module 2 is connected to the main body 1, the detachable module 2 is disposed into the connecting channel 13 of the insulation base 10 and fixed thereto by means of the fixing posts 131 on both sides of the connecting channel 13. In this way, the detachable module 2 can be prevented from sliding on the main body 1 easily.

The detachable module 2 includes a circuit board 21, an integrated circuit 211 and pin headers 212 both electrically connected to the circuit board 21. The pin headers 212 are soldered to one end of the circuit board 21. The pin headers 212 extend downwards and vertically from the circuit board 21. The positions and number of the pin headers 212 correspond to those of the pin header slots 14 of the main body 1. In the present embodiment, there are four pin headers 212, but it is not limited thereto.

The main body 1 is electrically connected to an external mother board (not shown) of a computer by means of the connecting terminals 113, 123 and the pins of the pin header slots 14. When the pin headers 212 of the detachable module 2 are inserted into the pin header slots 14 of the main body 1, the mother board can perform the functions of the integrated circuit 211 of the detachable module 2. In the present embodiment, the integrated circuit 211 may be a wireless transmission chip, such as a Bluetooth transmission chip, a Wireless Fidelity (Wi-Fi) transmission chip, a Radio Frequency (RF) transmission chip, and a third Generation (3G) transmission chip, but it is not limited thereto. In this way, the mother board can receive and transmit data of a wireless network by means of the main body 1.

The detachable module 2 further includes an antenna unit 214 electrically connected to the circuit board 21. The wireless signals generated by a wireless transmission chip is received by the antenna unit 214 of the detachable module 2. Further, the antenna unit 214 receives the external wireless signals and transmits these signals to the wireless transmission chip for subsequent processing. In order to prevent the problem that the antenna unit 214 has only one signal-receiving direction to make the wireless signal transmission unstable, the detachable module 2 further includes an external antenna adapter 215 electrically connected to the circuit board 21. By this arrangement, the detachable module 2 can be electrically connected to an external antenna (not shown) via the external antenna adapter 215. By using the external antenna having a larger area and more signal-receiving angles, the quality of wireless signal transmission is enhanced greatly.

The detachable module 2 further includes an upper cover 22 and a lower cover 23. The upper cover 22 and the lower cover 23 can be engaged with each other to generate an accommodating space 20 there between. The circuit board 21 and the integrated circuit 211 thereon are disposed in the accommodating space 20. One end of the lower cover 23 is provided with at least one open hole 231. The pin headers 212 of the circuit board 21 protrude out of the detachable module 2 via the open hole 231. More specifically, the open hole 231 provided on one end of the lower cover 23 allows the free ends of the pin headers 212 to protrude out of the detachable module 2 to insert into the pin header slots 14.

It should be noted that, when the detachable module 2 is disposed in the connecting channel 13, the fixing posts 131 on both sides of the connecting channel 13 press and fix both sides of the upper cover 22.

Figure 6:
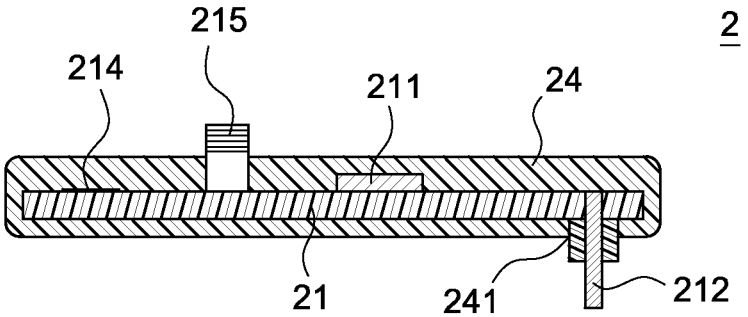
FIG. 6 is a schematic view showing a detachable module of another preferred embodiment of the present invention.

Please refer to FIG. 6, which is a schematic view showing a detachable module of another preferred embodiment of the present invention. According to the present embodiment, in the detachable module 2, the circuit board 21 and the integrated circuit 211 are not received between the upper cover 22 and the lower cover 23. The module 2 has a covering layer 24 made by plastic injection molding. The covering layer 24 directly covers the circuit board 21 and the integrated circuit 211. In this way, the thickness of the detachable module 2 can be reduced further to save its volume and occupied space. One end of the covering layer 24 is provided with at least one opening 241. The pin headers 212 of the circuit board 21 protrude out of the detachable module 2 via the opening 241. More specifically, the opening 241 allows the free ends of the pin headers 212 to protrude out of the detachable module 2 to insert into the pin header slots 14.

Figure 5:
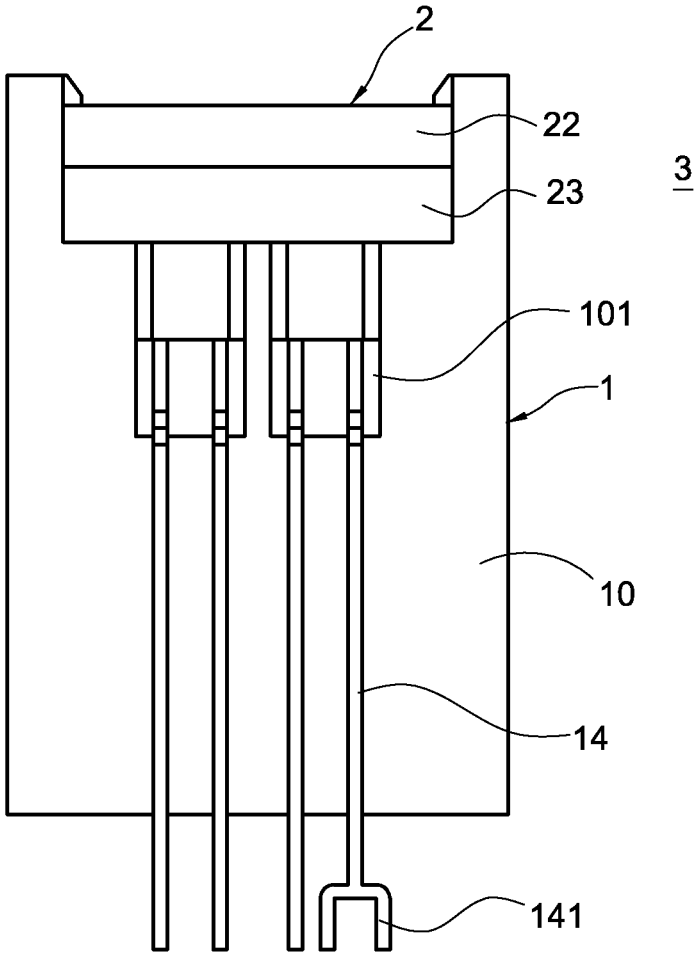
FIG. 5 is a rear view showing a preferred embodiment of the present invention.

Please refer to FIG. 5, which is rear view showing a preferred embodiment of the present invention. As shown in this figure, the pin of at least one of the pin header slots 14 is a Y-shaped pin 141 electrically connected to grounding lines of the mother board. By this arrangement, the connector 3 having the pin header slots 14 can be operated more stably.

Figure 7:
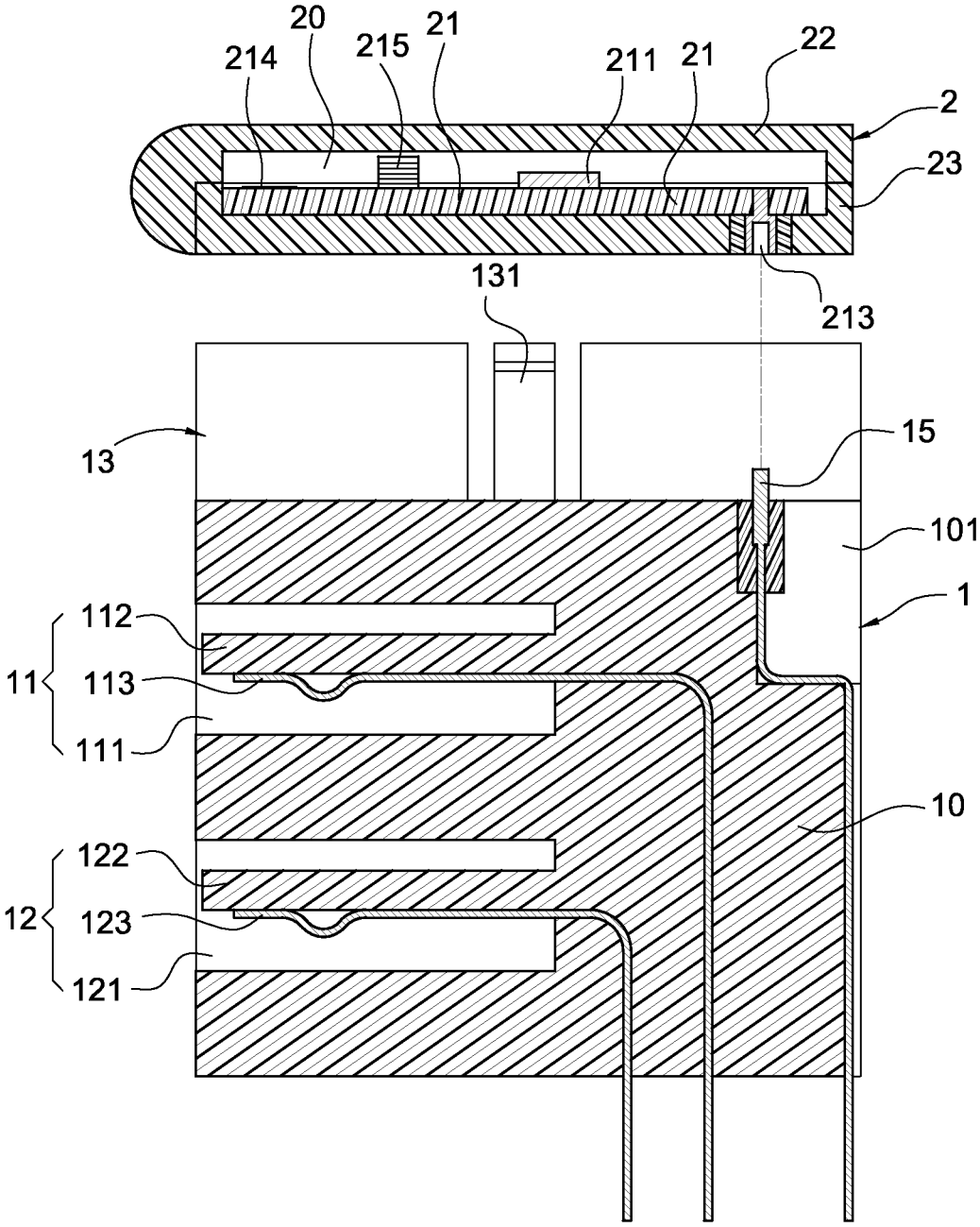
FIG. 7 is an assembled view showing another preferred embodiment of the present invention.

Please refer to FIG. 7, which is an assembled view showing another preferred embodiment of the present invention. As shown in this figure, the difference between the present embodiment and the previous embodiment lies in that: the main body 1 includes the insulation base 10 and the pin headers 15. The pin headers 15 are provided in the troughs 101 on the rear surface of the insulation base 10. Each of the pin headers 15 extends toward the top surface of the insulation base 10 and protrudes out of the insulation base 10. The free end of each pin header 15 is positioned to be perpendicular to the top surface of the insulation base 10.

In the present embodiment, the detachable module 2 includes the circuit board 21, the integrated circuit 211 and the plurality of pin header slots 213 both electrically connected to the circuit board 21. The pin header slots 213 are soldered to one end of the circuit board 21 and protrude downwards and vertically from the circuit board 21. The positions and number of the pin header slots 213 correspond to those of the pin headers 15 of the main body 1. The main body 1 is electrically connected to the external mother board by means of the connecting terminals 113, 123 and the pins of the pin headers 15. When the pin header slots 213 of the detachable module 2 are inserted by the pin headers 15 of the main body 1, the mother board can perform the functions of the integrated circuit 211 of the detachable module 2.

Figure 8:
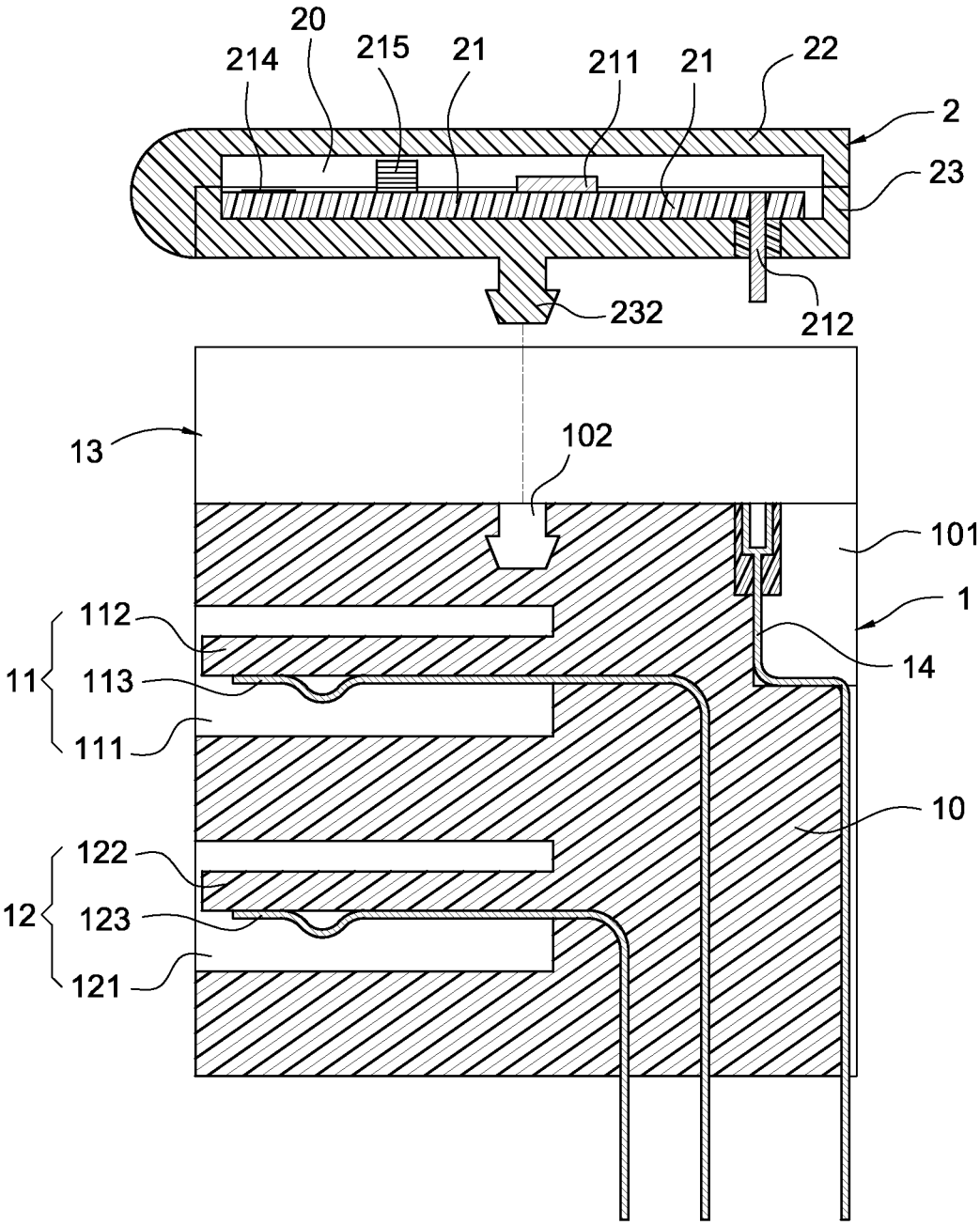
FIG. 8 is an assembled view showing a further preferred embodiment of the present invention.

Please refer to FIG. 8, which is an assembled view showing a further preferred embodiment of the present invention. In the present embodiment, as shown in this figure, the bottom surface of the lower cover 23 of the detachable module 2 is formed with a positioning post 232. The top surface of the insulation base 10 is provided with a positioning trough 102. The position and shape of the positioning trough 102 correspond to those of the positioning post 232. When the detachable module 2 is disposed in the connecting channel 13 of the main body 1 in such a manner that the pin headers 212 are electrically connected to the pin header slots 14, the positioning posts 232 is inserted into the positioning trough 102, thereby preventing the detachable module 2 from sliding. More specifically, the positioning post 232 is formed into an umbrella shape, and the positioning trough 102 is also formed into an umbrella shape correspondingly. However, the shape of the positioning post 232 and the positioning trough 102 is not limited thereto.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A connector including:

a main body having an insulation base and a plurality of pin header slots, a front surface of the insulation base being provided with at least one accommodating trough, each accommodating trough having a tongue piece, the tongue piece being provided with a plurality of connecting terminals, a rear surface of the insulation base being provided with a plurality of troughs, the pin header slots being disposed in the troughs, each pin header slot extending toward a top surface of the insulation base and being perpendicular to the top surface of the insulating base; and a detachable module comprising a circuit board, an integrated circuit and a plurality of pin headers both electrically connected to the circuit board, the pin headers extending downwards and vertically from the circuit board, the positions and number of the pin headers corresponding to those of the pin header slots on the main body, the pin headers of the detachable module being inserted into the pin header slots of the main body.

2. The connector according to claim 1, wherein the at least one accommodating trough, the tongue piece and the connecting terminals together constitute a Universal Serial Bus (USB) connecting port if the number of the connecting terminals is four; the at least one accommodating trough, the tongue piece and the connecting terminals together constitute an External Serial Advance Technology Attachment (e-SATA) connecting port if the number of the connecting terminals is seven.

3. The connector according to claim 1, wherein the top surface of the insulation base is provided with a connecting channel, both sides of the connecting channel are provided with a positioning post respectively, the detachable module is disposed in the connecting channel, and the positioning posts on both sides of the connecting channel are configured to fix the detachable module.

4. The connector according to claim 3, wherein the detachable module has an upper cover and a lower cover, the upper cover and the lower cover are engaged with each other to generate an accommodating space there between, the circuit board and the integrated circuit are disposed in the accommodating space, one end of the lower cover is provided with at least one open hole, and the pin headers of the circuit board protrude out of the detachable module via the open hole.

5. The connector according to claim 4, wherein a bottom surface of the lower cover is formed with a positioning post, the top surface of the insulation base is formed with a positioning trough, and the positioning post is inserted into the positioning trough when the pin headers are electrically connected into the pin header slots.

6. The connector according to claim 5, wherein the positioning post is formed into an umbrella shape, the positioning trough is also formed into an umbrella shape, and the position and shape of the positioning trough correspond to those of the positioning post.

7. The connector according to claim 3, wherein the integrated circuit is a wireless transmission chip.

8. The connector according to claim 7, wherein the detachable module further includes an antenna unit and an external antenna adapter both electrically connected to the circuit board.

9. The connector according to claim 3, wherein the detachable module has a covering layer made by plastic injection molding, the covering layer covers the circuit board and the integrated circuit, one end of the covering layer is provided with at least one opening, and the pin headers of the circuit board protrude out of the detachable module via the opening.

10. The connector according to claim 3, wherein at least one of the pin header slots has Y-shaped pins electrically connected to grounding lines of an external mother board.

11. A connector including:

a main body having an insulation base and a plurality of pin headers, a front surface of the insulation base being provided with at least one accommodating trough, each accommodating trough having a tongue piece, the tongue piece being provided with a plurality of connecting terminals, a rear surface of the insulation base being provided with a plurality of troughs, the pin headers being provided in the troughs, each pin header extending toward a top surface of the insulation base and protruding out of the insulating base, a free end of each pin header being perpendicular to the top surface of the insulation base; and a detachable module comprising a circuit board, an integrated circuit and a plurality of pin header slots both electrically connected to the circuit board, the pin header slots extending downwards and vertically from the circuit board, the positions and number of the pin header slots corresponding to those of the pin headers on the main body, the pin header slots of the detachable module being inserted by the pin headers of the main body.

12. The connector according to claim 11, wherein the at least one accommodating trough, the tongue piece and the connecting terminals together constitute a Universal Serial Bus (USB) connecting port if the number of the connecting terminals is four; the at least one accommodating trough, the tongue piece and the connecting terminals together constitute an External Serial Advance Technology Attachment (e-SATA) connecting port if the number of the connecting terminals is seven.

13. The connector according to claim 11, wherein the top surface of the insulation base is provided with a connecting channel, both sides of the connecting channel are provided with a positioning post respectively, the detachable module is disposed in the connecting channel, the positioning posts on both sides of the connecting channel are configured to fix the detachable module.

14. The connector according to claim 13, wherein the detachable module has an upper cover and a lower cover, the upper cover and the lower cover are engaged with each other to generate an accommodating space there between, the circuit board and the integrated circuit are disposed in the accommodating space, one end of the lower cover is provided with at least one open hole, and the pin header slots of the circuit board protrude out of the detachable module via the open hole.

15. The connector according to claim 14, wherein a bottom surface of the lower cover is formed with a positioning post, the top surface of the insulation base is formed with a positioning trough, and the positioning post is inserted into the positioning trough when the pin headers are electrically connected into the pin header slots.

16. The connector according to claim 15, wherein the positioning post is formed into an umbrella shape, the positioning trough is also formed into an umbrella shape, and the position and shape of the positioning trough correspond to those of the positioning post.

17. The connector according to claim 13, wherein the integrated circuit is a wireless transmission chip.

18. The connector according to claim 17, wherein the detachable module further includes an antenna unit and an external antenna adapter both electrically connected to the circuit board.

19. The connector according to claim 13, wherein the detachable module has a covering layer made by plastic injection molding, the covering layer covers the circuit board and the integrated circuit, one end of the covering layer is provided with at least one opening, and the pin header slots of the circuit board protrude out of the detachable module via the opening.

20. The connector according to claim 13, wherein one end of at least one of the pin headers has a Y-shaped pin electrically connected to grounding lines of an external mother board.

* * * * *